US008316567B2

(12) United States Patent
Douglas

(10) Patent No.: US 8,316,567 B2
(45) Date of Patent: Nov. 27, 2012

(54) EASY LOADING MAGAZINE

(76) Inventor: James Lee Douglas, Pueblo, CO (US)

( * ) Notice: Subject to any disclaimer, the term of this patent is extended or adjusted under 35 U.S.C. 154(b) by 96 days.

(21) Appl. No.: 12/615,626

(22) Filed: Nov. 10, 2009

(65) Prior Publication Data

US 2011/0107639 A1 May 12, 2011

(51) Int. Cl.
*F41A 9/82* (2006.01)

(52) U.S. Cl. ..... 42/50

(58) Field of Classification Search ..... 42/49.01, 42/50, 87

See application file for complete search history.

(56) References Cited

U.S. PATENT DOCUMENTS

| | | | | | |
|---|---|---|---|---|---|
| 370,518 | A | | 9/1887 | Haywood | |
| 376,901 | A | * | 1/1888 | Morris | 42/50 |
| 487,432 | A | * | 12/1892 | Sponsel | 42/50 |
| 1,044,983 | A | * | 11/1912 | Brown | 42/50 |
| 1,245,499 | A | * | 11/1917 | Orme | 42/7 |
| 1,299,303 | A | * | 4/1919 | Cowles | 42/50 |
| 1,350,619 | A | * | 8/1920 | Payne | 42/18 |
| 1,351,370 | A | * | 8/1920 | Chase | 42/7 |
| 1,797,951 | A | | 3/1931 | Gaidos | |
| 2,137,491 | A | * | 11/1938 | Huff | 42/90 |
| 2,862,324 | A | | 12/1958 | Ball | |
| 2,885,811 | A | * | 5/1959 | Womble, Jr | 42/50 |
| 3,509,655 | A | * | 5/1970 | Wilhelm | 42/50 |
| 4,139,959 | A | * | 2/1979 | Howard et al. | 42/50 |
| 4,329,802 | A | * | 5/1982 | Coonan | 42/50 |
| 4,488,371 | A | | 12/1984 | Boyles | |
| 4,514,922 | A | * | 5/1985 | Farrar et al. | 42/50 |
| 4,516,346 | A | * | 5/1985 | Farrar et al. | 42/50 |
| 4,580,364 | A | * | 4/1986 | Vyprachticky | 42/50 |
| 4,614,052 | A | | 9/1986 | Brown et al. | |
| 4,688,344 | A | * | 8/1987 | Kim | 42/50 |
| 4,827,651 | A | | 5/1989 | Conkey | |
| 4,829,693 | A | | 5/1989 | Holmes | |
| 4,872,279 | A | | 10/1989 | Boat | |
| 4,993,180 | A | | 2/1991 | Upchurch | |
| 5,129,173 | A | | 7/1992 | Kuykendall | |
| 5,309,660 | A | * | 5/1994 | Blackamore | 42/50 |
| 5,402,594 | A | | 4/1995 | Switzer | |
| 6,807,764 | B1 | | 10/2004 | Phillips | |
| 6,817,134 | B2 | * | 11/2004 | Newman | 42/87 |

(Continued)

OTHER PUBLICATIONS http://shopruger.com/Ruger-Mark-III-Blued-Magazine-10-Shot/productinfo/90231/.

(Continued)

*Primary Examiner* — Jonathan C Weber

(74) *Attorney, Agent, or Firm* — Albert Haegele; Leyendecker & Lemire, LLC

(57) ABSTRACT

Described herein are embodiments of a firearm cartridge clip including a housing that forms a chamber. The firearm cartridge clip has first and second slots laterally disposed on first and second sides of the housing, respectively. First and second tracks are laterally disposed on inner-sides of the first and second sides of the housing respectively. Each of the tracks have a slot that corresponds to either the first slot or the second slot. A platform is disposed on a central axis of the housing and is slideably coupled to the first track and the second track. A grip mechanism is coupled the platform and configured to enable an individual to laterally slide the platform along the first track and the second track. A locking mechanism is coupled to the grip mechanism and is configured to be inserted into a locking mechanism receiver disposed on a distal end of the housing, which holds the platform in place prior to loading the magazine.

3 Claims, 6 Drawing Sheets

U.S. PATENT DOCUMENTS

| | | | | |
|---|---|---|---|---|
| 7,200,964 | B2 | 4/2007 | Gates | |
| 7,497,044 | B2 | 3/2009 | Cammenga et al. | |
| 7,533,483 | B1 * | 5/2009 | Alzamora et al. | 42/50 |
| D603,911 | S * | 11/2009 | Halmone | D21/573 |
| 7,621,063 | B2 * | 11/2009 | Fitzpatrick et al. | 42/50 |
| 2004/0148838 | A1 * | 8/2004 | Conner | 42/49.01 |
| 2005/0150148 | A1 | 7/2005 | Herpel | |
| 2007/0169390 | A1 * | 7/2007 | Bubits | 42/7 |
| 2009/0107022 | A1 * | 4/2009 | Fitzpatrick et al. | 42/50 |
| 2010/0281737 | A1 * | 11/2010 | Cahill | 42/50 |
| 2011/0030259 | A1 * | 2/2011 | Castro et al. | 42/6 |

OTHER PUBLICATIONS http://shopruger.com/Ruger-Mark-III-22_45-Blued-Magazine/productinfo/90229/.

http://shopruger.com/Ruger-Mark-II-Blued-Magazine-10-Shot/productinfo/90046/.

http://shoprugercom/Ruger-Mark-I-Blued-Magazine-9-Shot/productinfo/90062/.

* cited by examiner

EASY LOADING MAGAZINE

TECHNICAL FIELD

The invention generally relates to cartridge clips for firearms.

BACKGROUND

Traditionally, when loading a cartridge clip or magazine for a firearm, the cartridge shells (e.g. ammunition) must be manually loaded one at a time through an opening on a top portion of the cartridge clip. Generally, each cartridge shell is pressed against a previously loaded shell and a clip spring contained in the cartridge clip is compressed. As each shell is inserted, strain on the fingers may increase which may cause the individual's hand to become tired and many individuals may not have the required strength or dexterity to manually load the cartridge clip. Other individuals may only able to partially load a cartridge clip due to the increased strength and dexterity required to continue to load the clip as the spring continues to be compressed. Alternatively, individuals who do have the required strength or dexterity to manually load a single cartridge clip, may not have the strength to manually load multiple cartridge clips. Furthermore, resistance of the clip spring can slow the speed at which a clip is loaded.

DETAILED DESCRIPTION

Figure 1A:
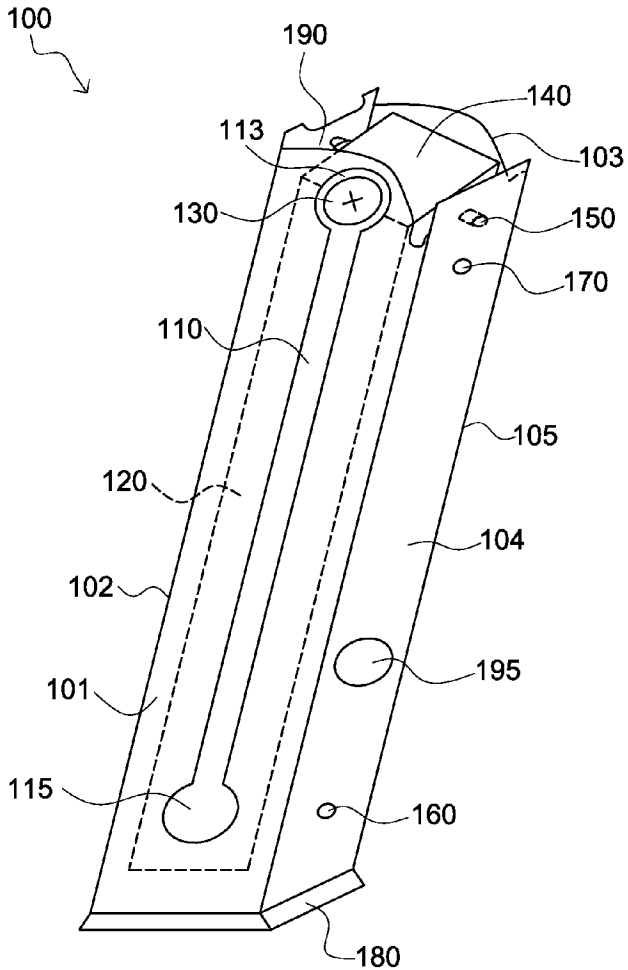
FIG. 1A is an isometric view of an easy loading cartridge clip according to embodiments.

This disclosure will now more fully describe exemplary embodiments with reference to the accompanying drawings, in which specific embodiments are shown. Other aspects may be embodied in many different forms and the inclusion of specific embodiments in the disclosure should not be construed as limiting such aspects to the embodiments set forth herein. Rather, the embodiments depicted in the drawings are included to provide a disclosure that is thorough and complete and which fully conveys the intended scope to those skilled in the art. When referring to the figures, like structures and elements are shown throughout are indicated with like reference numerals.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

The term "inner-side" as used herein and in the appended claims refers to the magazine body well of the magazine body or housing. Thus the inner-side of the housing is the inside surface area of the magazine body.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Described herein are embodiments for an easy loading firearm cartridge clip. In embodiments the firearm cartridge clip comprises a housing that forms a chamber. The housing has a bottom end and a top end. The bottom end may be removable and the top end has an opening that is configured to receive ammunition and feed the ammunition into a firearm. The firearm cartridge clip also has first and second slots laterally disposed on first and seconds sides of the housing respectively. The length of each slot is substantially equivalent to a length of the housing. First and second tracks are laterally disposed on inner-sides of the first and second sides of the housing respectively. Each of the first and second tracks has a slot that corresponds to either the first slot or the second slot depending on where the track is located. The first track and the second track has a length substantially equivalent to the length of the housing. A platform is disposed on a central axis of the housing and is slideably coupled to the first track and the second track. A grip mechanism is also included and is coupled to an underside of the platform. The grip mechanism is configured to enable an individual to laterally slide the platform along the first track and the second track. A locking mechanism is coupled to the grip mechanism and is configured to be inserted into at least one locking mechanism receiver that is disposed on a distal end of the housing. When the locking mechanism is secured in the locking mechanism receiver, the platform is secured at the location of the locking mechanism receiver.

In another embodiment, a method for loading a firearm cartridge clip is disclosed. According the embodiments, a plurality of gripping mechanisms are coupled to a platform and a locking mechanism. The plurality of gripping mechanisms are extended and guided in a downward direction by slots disposed on opposite sides of a housing of the firearm cartridge clip. The slots have a length substantially equivalent to a length of the housing. When a downward force is exerted on the plurality of gripping mechanisms, the platform, being slideably coupled to at least one track located on at least one inner-side of the housing, laterally slides along the track in the downward direction. The locking mechanism is inserted into at least one of a plurality of locking mechanism receivers located on the cartridge clip. Once the platform is secure, ammunition is inserted into the cartridge clip via an opening in the housing which configured to receive ammunition.

In still yet other embodiments a cartridge clip for a firearm is disclosed. In such embodiments a housing is disclosed having at least a first side, a second side, a third side, and a fourth side. The first and second sides have a first width and the third side and the fourth side have a second width. A first slot is laterally disposed on the first side of the housing and a second slot is laterally disposed on the second side of the housing. Each of the first slot and the second slot have a length substantially equivalent to a length of the housing of the cartridge clip. At least one track is disposed on at least one inner-side of the housing. A plurality of gripping mechanisms are included and configured to slide along the first slot and the second slot. An ammunition support platform is coupled to the plurality of gripping mechanisms and is slideably coupled to the at least one track.

FIG. 1A is an isometric view of an easy loading magazine 100 (e.g. cartridge clip) according to embodiments. The easy loading magazine 100 and the concepts described herein may be used, or be configured to be used, in many different types of firearms as well as firearms of different calibers. For example, the magazine described herein may be used for a .22, .24, .28, .45 and .50 caliber handgun to name a few. The magazine may also be used in rifles and other such firearms. Additionally, the magazine may be configured as a single stack magazine or a double stack magazine.

The easy loading magazine 100 may have a housing 105 (e.g., magazine housing) consisting of at least four sides: a first side 101, a second side 102, a third side 103 and a fourth side 104, coupled together to form a chamber. Embodiments provide that two of the sides have a first width while the remaining two sides have a second width that is greater than the first width. The two sides with the first width can be located opposite one another and adjacent to the two sides having the larger width. Such a configuration gives the housing 105 a rectangular shape. It is contemplated however that many other configurations are possible such that the housing 105 resembles a square or other such shape.

As shown in FIG. 1A, at least one side of the housing 105 has a slot 110 contained therein. According to embodiments, slot 110 is a narrow channel that has a length substantially equivalent to a length of the housing 105 and allows a spring compression grip to be pulled down the housing until a ball plunger or other locking mechanism locks a spring of the magazine in place. As will be explained below, the spring compression grip may be a ball plunger or threaded screws that extend and contract for the purpose of getting a good grip to compress a spring in the magazine until it locks out via locking mechanism receiver (e.g., a ball plunger lockout hole) disposed in the housing. The slot 110 has top round opening 113 and a bottom round opening 115 into which a grip extender bolt 130 or other gripping mechanism (e.g., ball plunger) may be retracted or extended. The portion of the slot 110 between the top opening 113 and the bottom opening 115 is narrower than each of the round openings 113 and 115 and is configured to allow a shaft of the grip extender bolt 130 to laterally move in the slot 110 while preventing virtually all movement of the grip extender bolt 130 in a horizontal direction.

Although only a single slot 110 is shown on a first side 101 of the housing 105, embodiments provide that a second slot 110 can be disposed on an opposite side, such as for example, the third side 103 of the housing 105. As shown in FIG. 1A, the first side 101 and the third side 103 of the housing are the more narrow sides of the housing 105. However, it is contemplated that a slot 110 may be disposed on any combination of the second side 102 and the fourth side 104 of the housing 105 which have the second, wider width.

According to embodiments a track 120 is disposed on at least one inner-side of either the first side 101, second side 102, third side 103 or fourth side 104 of the housing 105. As shown in FIG. 1A, the track 120 has a length that is substantially equivalent to a length of the housing 105. Embodiments provide that the track 120 has a slot that corresponds to the slot 110 of the housing 105. The slot of the track 120 and the slot 110 of the housing are positioned in a manner so that the slots are flush and do not hinder lateral movement along the slots. The joining of the slot 110 and the slot of the track 120 enables a grip extender bolt 130 or other gripping mechanism to pass through both the slot 110 on the housing 105 as well as the track 120 to enable a platform 140 to laterally move along an axis of the housing 105.

Although FIG. 1A shows a track 120 disposed on the same side (e.g. the first side 101) as the slot 110, it is contemplated that the track 120 can be laterally disposed on a different side (e.g., second side 102) of the housing 105 while the slot 110 is disposed on the first side of the housing 105. In such embodiments, the track 120 may not necessarily contain a slot that corresponds to slot 110. However, as will be discussed in greater detail below, regardless of what inner-side the track 120 is disposed on, the track 120 is configured to be a guide to the platform 140 as the platform moves up and down a central axis of the housing 105.

Still yet other embodiments provide that a slot 110 and track 120 having a corresponding slot are provided on multiple inner-sides of the housing 105. For example, the housing 105 may have a slot 110 on a first side 101 and a third side 103 of the housing 105. In such embodiments, a track 120, with corresponding slots, is also laterally disposed on an inner-side of both the first side 101 and the third side 103 of the housing 105. Alternatively, a track 120 may be laterally disposed on the inner-side of either, or both, the second side 102 and the fourth side 104 of the housing 105. Although specific examples have been given, it is contemplated that a slot 110 and a track 120, either with or without a corresponding slot, may be disposed on any of the sides of the housing 105 in various combinations.

Still yet other embodiments provide that a track 120 may be laterally disposed on at least one inner corner edge of the housing. For example, a track may be located on a rounded edge between the first side 101 and the second side 102 of the housing 105.

The magazine 100 also includes a grip extender bolt 130 according to embodiments. The grip extender bolt 130 is part of a gripping mechanism and is configured to retract and extend when at least a portion of the grip extender bolt 130 is contained within either the top round opening 113 or the bottom round opening 115 of the slot 110. A shaft of the grip extender bolt 130 passes through the slot 110 and, depending on the configurations discussed above, can also pass through the track 120 via the corresponding slot. In embodiments, the head of the grip extender bolt is slightly grooved to give an individual a better grip on the grip extender bolt 130. The top of the head of the grip extender bolt 130 may have a recess to allow a screwdriver, ratchet or other tool to be inserted into the recess to assist in turning the grip extender bolt. Additionally, the shaft of the grip extender bolt 130 is threaded and may be extended and retracted by turning the grip extender bolt 130 in either a clockwise or counterclockwise rotation. Alternatively, the grip extender bolts 130 can be pressure sensitive grips that extend and contract based on pressure being applied to the grips.

When the grip extender bolt 130 is in an extended position, an individual loading the magazine can grip the grip extender bolt 130 and exert a downward force. Because the shaft of the grip extender bolt 130 is coupled to the platform 140, the platform 140 moves in the same direction as the applied force. When the grip extender bolts 130 are in the retracted position, the body of the grip extender bolt 130 is contained within the housing. The head of the grip extender bolt 130 sits flush against the side of the housing 105. Other embodiments provide that the grip extender bolts 130 are entirely removable from the gripping mechanism.

According to embodiments, the platform 140 is configured to support the ammunition (e.g. cartridge shells) as the ammunition is being loaded through the top portion 190 of the magazine 100. The platform 140 also separates the ammunition from a resistance spring located below the platform. The combination of the platform and the resistance spring enable the shells to be inserted into a barrel of a firearm when a previously loaded shell has been discharged. Typically, as shells are loaded into the magazine 100, the platform moves in a downward motion toward the bottom 180 of the magazine 100 and as shells are discharged, the platform moves toward the top of the magazine until the magazine is empty.

The platform 140 is coupled, via the gripping mechanism, to a locking mechanism 150 according to embodiments. The locking mechanism 150 may be inserted into a locking mechanism receiver 160 located at various points on the housing 105. When the locking mechanism 150 is secured in the locking mechanism receiver 160 the platform is secured in that specific location. Although FIG. 1A shows a single locking mechanism receiver 160 located on a lower end of the housing 105, it is contemplated that multiple locking receiver mechanisms 160 may be located at various points along the housing 105. It is also contemplated that the locking mechanism receiver 160 may be located on either the first side 101, the second side 102, the third side 103, the fourth side 104 or any combination thereof.

For example, a first locking mechanism receiver may be located at a halfway point on the housing 105 while a second locking mechanism receiver may be located on a bottom portion of the housing 105. Thus, the locking mechanism 150 may be inserted into the first locking mechanism receiver and shells may be loaded to the halfway point. Pressure can be applied to the locking mechanism to release the locking mechanism from the first locking mechanism receiver and the platform can be lowered to the second locking receiver mechanism. Once the platform is secured, additional shells may be loaded until the magazine has reached capacity.

As briefly discussed above, the housing 105 has a top end 190 configured to receive ammunition and feed the ammunition into a firearm. According to embodiments, the top end 190 of the housing may be slightly tapered to form a more narrow opening than is present in the remaining portions of the body of the housing 105. In yet other embodiments, the width of the opening on the top of the housing may have a width corresponding to a width of the rest of the housing 105.

In embodiments, housing 105 also includes a bottom end 180. The bottom end 180 is removable to allow locking mechanisms, loading springs, round keepers etc., to be inserted into the housing 105. According to embodiments, the bottom end 180 of the housing 105 is configured to entirely seal the bottom end of the magazine. In embodiments where tracks 120 are located on any of the inner-sides of the housing, the bottom end 180 can be configured so at least a portion of the bottom end 180 is slideably coupled a bottom portion of the tracks 120.

Housing 105 also has at least one magazine catch 170 which is used to secure the magazine 100 in place when the magazine 100 is inserted into a firearm. Although FIG. 1A shows the magazine catch 170 located on an upper portion of the fourth side 104 of the housing, it is contemplated that the magazine catch 170 may be located on any side and in any location on the housing 105.

Still yet other embodiments provide that a magazine loading hole 195 may be disposed in one, some, or all sides of the housing 105. The magazine loading hole 195 has a diameter slightly larger than the caliber of shell being loaded into the magazine 100. The magazine loading hole 195 can be used to load shells into the magazine when the platform is at a position lower than the magazine loading hole 195. For example, the if platform 140 is in a locked position at the bottom end of the magazine, as an alternative to inserting shells though the top opening 190 of the housing 105, shells may be loaded through the magazine loading hole 195. Such a configuration may reduce the occurrence of shells tipping and/or getting caught in the center of the magazine as they are being loaded from the top end 190.

Figure 1C:
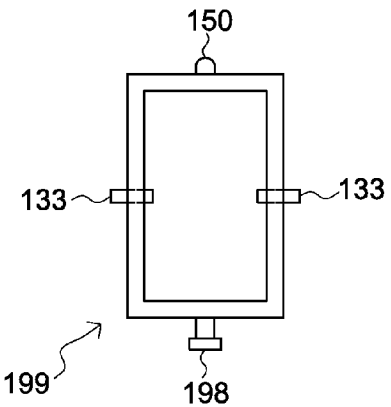
FIG. 1C is a top view of a spring/round keeper according to embodiments.
Figure 1B:
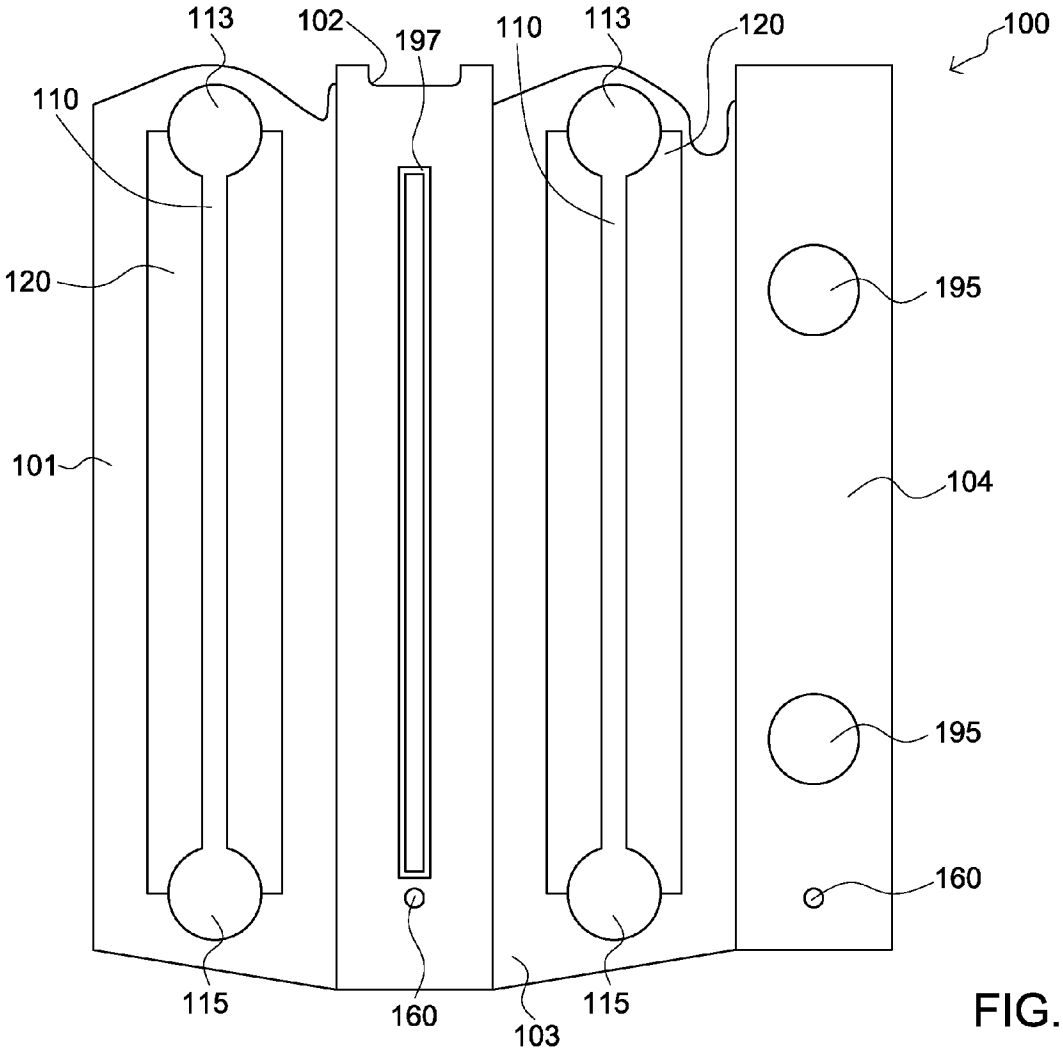
FIG. 1B is a sectional view of the easy loading cartridge clip according to embodiments.

FIG. 1B is a sectional view of the housing 105 of the easy loading cartridge clip 100 according to embodiments. The depiction shown in FIG. 1B shows the housing 105 as flat to more easily show and describe the various tracks and slots that are disposed on the each of the inner-sides of the housing 105. As described above, each of the first side 101 and the third side 103 of the housing 105 have a slot 110 that has a length substantially equivalent to a length of the housing 105. A track 120 is also disposed on the first side 101 and the third side 103. The track has a slot disposed in the center that corresponds to the track 110. Embodiments provide that the track may also have an opening or a partial opening that corresponds to either top opening 113, bottom opening 115 or a combination thereof.

Embodiments provide that an I-rail track 197 is disposed on a second side 102 of the housing 105. The I-rail track 197 has an opening in the center configured to mate with a spring/round keeper I-rail 198 (FIG. 1C). The I-rail track 197 has a length that is substantially equivalent to a length of the housing 105.

A locking mechanism receiver 160 (e.g., a ball plunger lockout hole) is also disposed on the second side 102 of the housing 105 according to embodiments. The locking mechanism receiver 160 is configured to receive at least a portion of the locking mechanism 150 (e.g. ball plunger) when a spring/round keeper (e.g., platform 140) has been slideably moved to a position near a bottom portion of the housing 105.

The fourth side 104 of the housing 105 also contains a ball plunger lockout hole 160 according to embodiments. The fourth side of the housing may also have a plurality of magazine loading holes 195 disposed therein. The holes may be positioned in such a manner that different holes may be used depending on how full the magazine cartridge clip is. For example, a bottom magazine loading hole may be used when the magazine is empty, and a top magazine loading hole may be used when the magazine cartridge clip is nearing capacity.

FIG. 1C is a top view of a spring/round keeper 199 according to embodiments. The spring/round keeper 199 is a part of the magazine that mates with the top of a spring contained in the magazine. The spring/round keeper 199 shown in FIG. 1C may be the spring/round keeper 220 (FIG. 2B) according to embodiments. Other embodiments provide that the spring/round keeper 199 may be coupled to the platform 140, be the platform 140 or be a portion of the platform 140. Still yet other embodiments provide that the spring/round keeper 199 may be coupled to the gripping mechanism 200 (FIG. 2A). Additionally, the gripping mechanism 200 (FIG. 2A) or portions thereof, may be incorporated into the spring/round keeper 199.

Embodiments provide that the spring/round keeper 199 has grip extender slots 133 disposed on opposite sides of the spring round keeper 199. The grip extender slots 133 are configured to receive the grip extender bolts 130. The grip extender slots 133 may be threaded to enable a threaded portion of the grip extender bolts 130 to be mated therein. In other embodiments, the grip extender slots may be configured to receive and/or hold other gripping mechanisms.

The spring/round keeper 199 also has a locking mechanism 150 disposed on at least one side. The locking mechanism may be a ball plunger in embodiments. The locking mechanism 150 is configured to lock the spring/round keeper in place when the locking mechanism is inserted into a locking mechanism receiver such as locking mechanism receiver 160 (FIGS. 1A-1B).

A spring/round keeper I-rail 198 is disposed on yet another side of the spring/round keeper 199 according to embodiments. The spring/round keeper I-rail 198 is configured to be slideably coupled to the I-rail track 197 of the housing 105. The combination of the I-rail track 197 and the spring/round keeper I-rail 198 may be useful to help keep the spring/round keeper 199 sliding smoothly as it travels along the inner-sides of the housing 105.

Figure 2B:
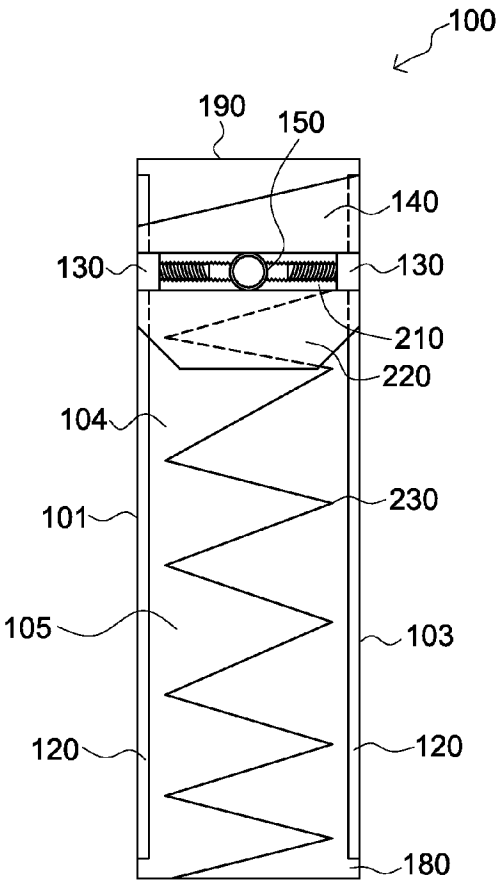
FIG. 2B is a side cutout view of the gripping mechanism being inserted into an easy loading magazine according to embodiments.
Figure 2A:
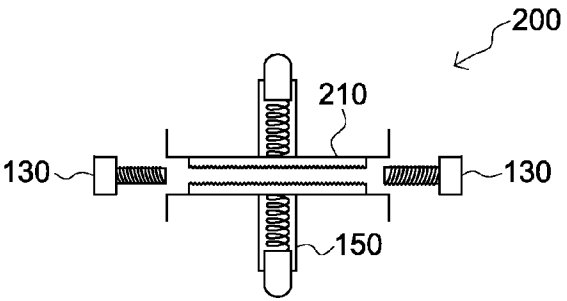
FIG. 2A is a top view of a gripping mechanism according to embodiments.

FIGS. 2A and 2B illustrate various aspects and features of a magazine 100 according to embodiments. FIGS. 2A and 2B also show components that were first described with respect to FIG. 1A and therefore the description of FIGS. 2A and 2B, as well as FIG. 3A-FIG. 5 may refer to at least one component described in FIG. 1. However, any references to components of FIG. 1A are for descriptive purposes only.

FIG. 2A is a top view of a gripping mechanism 200 according to embodiments. As shown in FIG. 2A, the gripping mechanism 200 is comprised of a tunnel spacer 210 and a locking mechanism 150 (FIG. 1). According to embodiments, the locking mechanism 150 may be a ball plunger. Use of a ball plunger may enable the locking mechanism to be easily removed from a locking mechanism receiver as an individual may only need to depress the ball plunger to free the locking mechanism from the locking mechanism receiver.

As explained above, the gripping mechanism 200 includes a plurality of grip extender bolts 130. The grip extender bolts 130 are configured to fit within the tunnel spacer 210 when in a contracted state. According to embodiments, the tunnel spacer 210 is threaded and enables a threaded shaft of the grip extender bolts 130 to be inserted therein. When in an extended state, a shaft of the grip extender bolts 130 may partially remain in the tunnel spacer. Thus, when a downward force is applied to the grip extender bolts 130, the gripping mechanism 200 moves in the downward direction. Embodiments also provide that the grip extender bolts 130 can be entirely removed from the tunnel spacer 210.

FIG. 2B is a side cutout view of a magazine 100 (FIG. 1) in combination with the gripping mechanism 200 according to embodiments. As shown in FIG. 2B, the gripping mechanism 200 is contained within the housing 105 of the magazine 100. The gripping mechanism 200 is coupled to a platform 140 via the tunnel spacer 210. The tunnel space 210 can also be coupled to a spring/round keeper 220. Spring/round keeper 220 is hollow to enable the locking mechanism 150 to be coupled to the tunnel spacer 210. The locking mechanism 150 may also be coupled to the tunnel spacer 210.

Figure 3B:
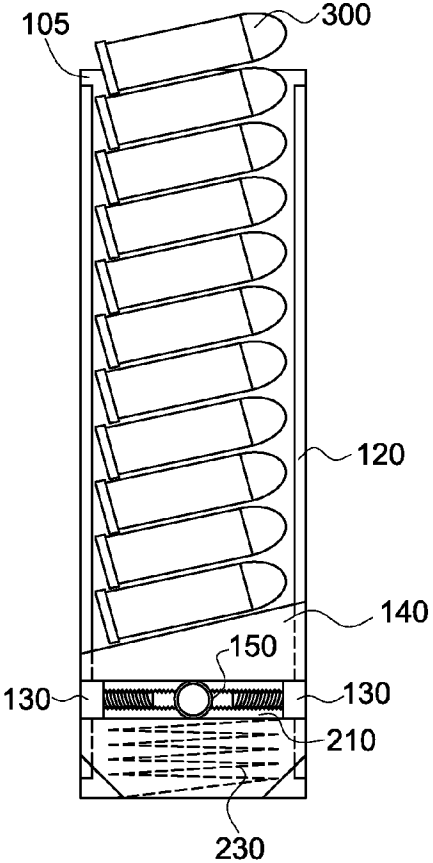
FIG. 3B is a side cutout view of a gripping mechanism being locked in a compressed position according to embodiments.
Figure 3A:
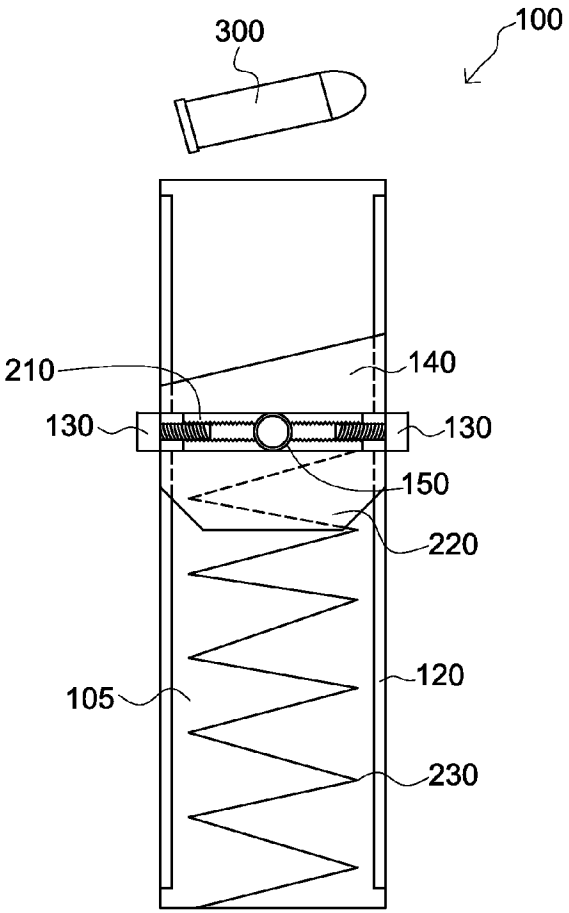
FIG. 3A is a side cutout view of a gripping mechanism being used to load ammunition into an easy loading magazine according to embodiments.

FIG. 3A is a side cutout view of a gripping mechanism 200 being used to load ammunition into an easy loading magazine 100 according to embodiments. As shown in FIG. 3A although the grip extender bolts 130 are in an extended state, at least a portion of the shaft of the grip extender bolts 130 remain in the tunnel spacer 210.

Once the grip extender bolts 130 have been extended, downward pressure is exerted on the bolts which causes the gripping mechanism 200 and the platform 140 to move in a downward motion. The platform 140 is slideably coupled to the tracks 120. Thus, the platform may use the tracks 120 as guides as the platform laterally moves along the slot 110 in the housing 105.

When the gripping mechanism 200 reaches locking mechanism receiver on the housing 105 where a locking mechanism receiver is located, the locking mechanism 150 may be inserted into the locking receiver mechanism. Such a configuration holds the platform 140 in place while ammunition 300 is loaded into the magazine 100.

FIG. 3B is a side cutout view of the gripping mechanism 200 in a locked position at a distal end of a magazine 100 according to embodiments. As shown in FIG. 3B, the grip extender bolts 130 may be returned to a retracted state so that a head of the grip extender bolts 130 are flush against the sides of the housing 105. However, prior to retracting the grip extender bolts 130, the locking mechanism 150 is inserted into a locking mechanism receiver 160 (FIG. 1). The use of the locking mechanism receiver 160 holds the platform 140 in a locked stated (e.g., stationary position) as the grip extender bolts 130 are retracted. Ammunition 300 may then be inserted into the magazine 100. As multiple locking receiver mechanisms may be present on the housing 105, the spring 230 may be partially compressed (FIG. 3A) then fully compressed (FIG. 3B) when loading the ammunition 300. As a result strain on the fingers can be reduced when manually loading the magazine. It is also contemplated that when the spring 230 is either partially compressed or fully compressed, ammunition may be loaded through a magazine loading hole 195 as described above.

Figure 4B:
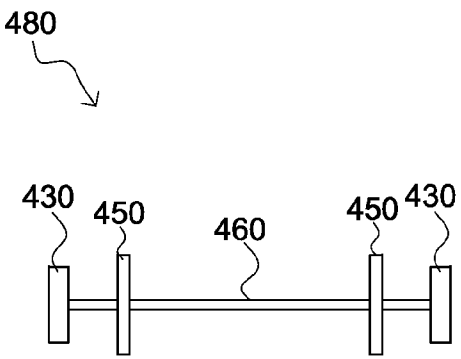
FIG. 4B is a side view of a gripping mechanism for use with the easy loading magazine of FIG. 4A according to an embodiment.
Figure 4A:
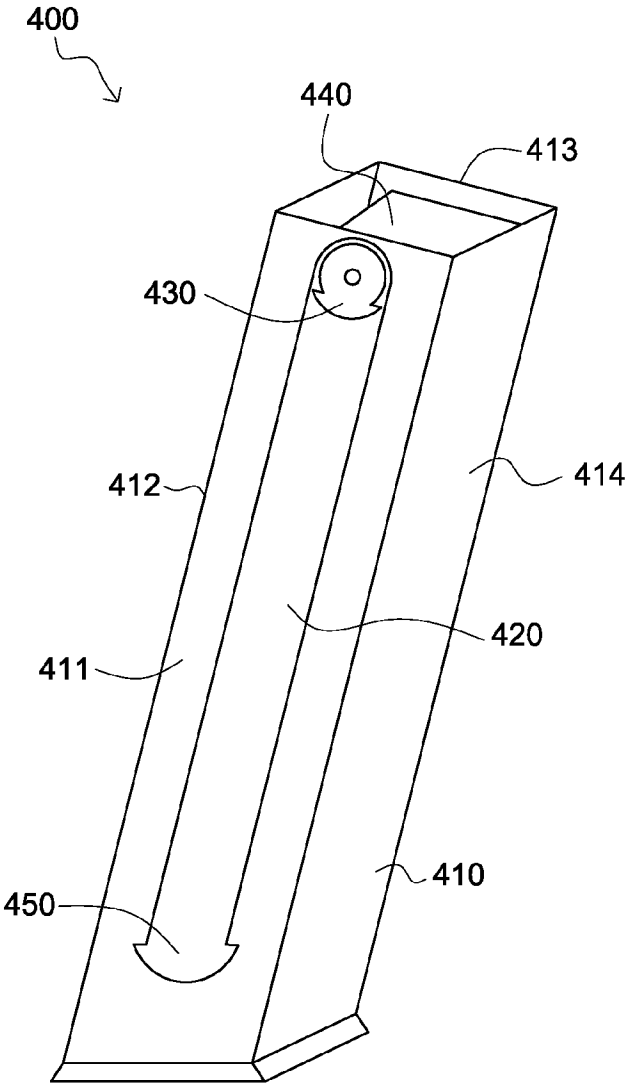
FIG. 4A is an isometric view of an easy loading magazine according to according to alternative embodiments.

FIG. 4A is an isometric view of an easy loading cartridge 400 according to according to alternative embodiments. The embodiments described below may be used in either a single stack or double stack magazine. Additionally, the concepts described below may be used for any firearm that requires a magazine to feed ammunition into the firearm (e.g. rifle, .45 caliber handgun etc.).

The housing 410 of the easy loading cartridge 400 consists of a first side 411, a second side 412, a third side 413 and a fourth side 414. According to embodiments, two of the sides have a first width and the remaining two sides have a second width that is greater than the first width. For example, the first side 411 and the third side 413 of the housing 410 have the first width while the second side 412 and the fourth side 414 of the housing 410 have the second width. A platform 440 is disposed on a top portion of the housing 410 and is configured to receive and support ammunition as the ammunition is being loaded into the magazine 400.

According to embodiments, at least one side of the housing has a slot 420. The slot 420 has a length substantially equivalent to a length of the housing 410. The slot 420 has a locking mechanism 450 disposed on a distal end. Although FIG. 4A shows the slot 420 disposed on the first side 411 of the housing 410, it is contemplated that a corresponding slot 420 may also be disposed on the third side 413 of the housing 410. Alternatively, the slot may be disposed on the second side 412 of the housing 410, the fourth side 414 of the housing 410, or any combination thereof.

In embodiments, a spring compression grip 430 is disposed on the same side of the housing 410 on which the slot 420 is located. The spring compression grip 430 is configured to fit, at least partially, within an opening of the slot 420. The spring compression grip can also be notched. The notch is configured to mate with a locking mechanism 450 located on a distal end of the slot 430. The spring compression grip 430 is also configured to laterally slide along the slot 420 using the slot 420 as a guide. According to embodiments, the spring compression grip 430 is coupled to the platform 440. Thus, as the spring compression grip 430 laterally moves along the slot 420, the platform 440 moves in a similar fashion.

When the spring compression grip 430 reaches the locking mechanism 450, the gripping mechanism may be slightly moveable in a horizontal direction to enable at least the notched portion of the spring compression grip 430 to be inserted into the locking mechanism 450. When the spring compression grip 430 has been at least partially inserted into the locking mechanism 450, ammunition may be loaded into the magazine 400 without having to manually push down the platform 440 as each shell is loaded.

FIG. 4B is a side view of a gripping mechanism 480 for use with a magazine 400 according to an embodiment. The gripping mechanism 480 consists of spring rod keeper 460, two discs 450 and two spring compression grips 430. Each spring compression grip 430 and disc 450 are disposed on opposite ends of the spring rod keeper 460. Embodiments provide that the ends of the spring rod keeper 460 are at least partially threaded. The threaded portions of the spring rod keeper 460 enable a threaded portion of the spring compression grip 430 to mate with the spring rod keeper 460 and be secured thereon. The discs 450 are located behind each of the spring compression grips 430. The placement of the discs 450 on the spring rod keeper 460 help keep the spring rod keeper 460 horizontal as the gripping mechanism 480 is laterally moved along the slot 420. Although not shown, it is contemplated that at least one track may be disposed on an inner side of the housing 410 to further assist movement of the platform 440 and gripping mechanism 480 in the lateral direction. As with other embodiments discussed above, multiple tracks may be used and disposed on each of the inner-sides of the housing 410.

Figure 5:
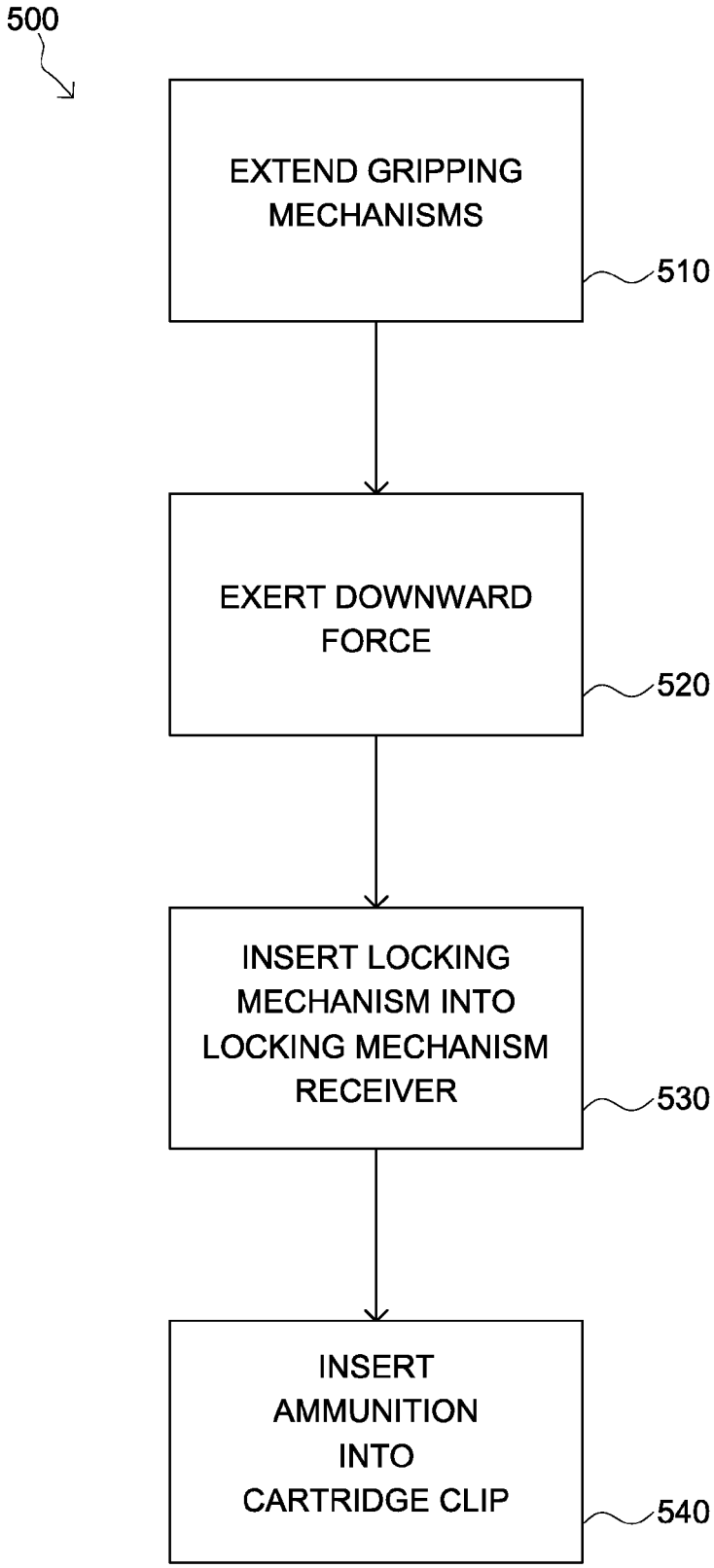
FIG. 5 is a flow chart describing a process for loading ammunition into an easy loading magazine according to embodiments.

FIG. 5 is a flow chart describing a process 500 for loading ammunition into an easy loading magazine according to embodiments. The method 500 starts by extending the gripping mechanisms. The gripping mechanisms may be similar to the grip extender bolts 130 (FIG. 1). The gripping mechanisms can be turned in a clockwise or counterclockwise manner in order to extend the bolts past the housing in which they are contained. In embodiments where the gripping mechanism consists of pressure sensitive gripping mechanism, pressure may be applied to the gripping mechanism to loose the gripping mechanism from the housing.

Step 520 provides that a downward force is applied to the gripping mechanism. The downward force may be applied by an individual who grips each of the grip extender bolts with a single hand and exerts a downward force on the grip extender bolts. As the downward pressure is being exerted, a platform, such as for example, platform 140 (FIG. 1) laterally moves along a central axis of the housing of the magazine. According to embodiments, the platform may be slideably coupled to one or more tracks located on the inner-sides of the housing.

In step 530 a locking mechanism is inserted into a locking mechanism receiver. For example, locking mechanism 150 (FIG. 1) may be inserted in to a locking mechanism receiver 160 (FIG. 1). As previously discussed, the housing may have one or more locking receiver mechanisms disposed along various points of the housing. Such a configuration enables the platform to be secured at various points which may allow easier loading of shells into the magazine.

Once the locking mechanism has been inserted into the locking mechanism receiver, flow proceeds to step 540 in which ammunition is inserted through a top opening into the magazine. In situations where the locking mechanism has been inserted into a locking mechanism receiver at various points along the housing, the method 500 may be repeated until the magazine is fully loaded.

Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations.

What is claimed is:

1. A cartridge clip for a firearm comprising:

a housing having at least a first side and a second side having a first width and a third side and fourth side having a second width;

a first slot laterally disposed on the first side and a second slot laterally disposed on the second side, wherein each of the first slot and the second slot have a length substantially equivalent to a length of the cartridge clip;

a locking mechanism disposed at a distal end of the first slot, the locking mechanism including a notched opening;

at least one track disposed on at least one inner-side of the housing;

a gripping mechanism including:

a spring rod keeper comprising two ends;

a first spring compression grip disposed on one of the two ends, the first spring compression grip at least partially residing in the first slot and including a notched portion adapted to mate with the notched opening;

a second spring compression grip disposed on another of the two ends, the second compression grip at least partially residing in the second slot;

first and second discs for keeping the spring rod keeper horizontal, the first and second discs residing on the spring rod keeper directly adjacent to an inner-side of the housing first side and an inner-side of the housing second side, respectively; and a platform, the platform being (i) slideably coupled to the at least one track, (ii) coupled to the gripping mechanism and (iii) configured to support ammunition for the firearm.

2. The cartridge clip of claim 1, wherein the gripping mechanism is configured to move horizontally to enable the notched portion of the spring compression grip to be inserted into the locking mechanism.

3. The cartridge clip of claim 2, wherein the compression grip is threadably coupled to the spring rod keeper.

* * * * *